US005084154A

United States Patent [19]

Wakizoe et al.

[11] Patent Number: 5,084,154

[45] Date of Patent: Jan. 28, 1992

[54] HYDROGEN-EVOLUTION ELECTRODE HAVING HIGH DURABILITY AND STABILITY

[75] Inventors: Masanobu Wakizoe; Yasuhide Noaki, both of Nobeoka, Japan

[73] Assignee: Asahi Kasei Kogyo Kabushiki Kaisha, Osaka, Japan

[21] Appl. No.: 563,059

[22] Filed: Aug. 6, 1990

[30] Foreign Application Priority Data

Aug. 18, 1989 [JP] Japan ..... 1-211373

[51] Int. Cl.[5] ..... C25B 11/06

[52] U.S. Cl. ..... 204/290 R; 204/291

[58] Field of Search ..... 204/290 R, 291, 292, 204/293

[56] References Cited

U.S. PATENT DOCUMENTS 3,977,958 8/1976 Caldwell et al. ..... 204/290 R
3,992,278 11/1976 Malkin et al. ..... 204/242
4,496,453 1/1985 Yoshida et al. ..... 204/290 R
4,605,484 8/1986 Shiroki et al. ..... 204/290 R
4,839,015 6/1989 Wakamatsu et al. ..... 204/290 R

FOREIGN PATENT DOCUMENTS 60-026682 9/1985 Japan .
2018833 10/1979 United Kingdom .

*Primary Examiner*—John Niebling
*Assistant Examiner*—Kathryn Gorgos
*Attorney, Agent, or Firm*—Birch, Stewart, Kolasch & Birch

[57] ABSTRACT

A highly durable, stable electrode having a coating comprised of an oxide of at least one metal selected from nickel and cobalt, which coating additionally contains titanium and zirconium components in proportions of 0.1. to 3.5% in terms of atomic percentage of titanium and 0.1 to 3% in terms of atomic percentage of zirconium, respectively. The electrode can advantageously be used in electrolyses in which hydrogen is evolved on the electrode, such as electrolyses of an alkali metal chloride and water. The electrode advantageously exhibits a low hydrogen overvoltage, enabling electrolysis to be performed stably for a prolonged period of time.

4 Claims, 1 Drawing Sheet

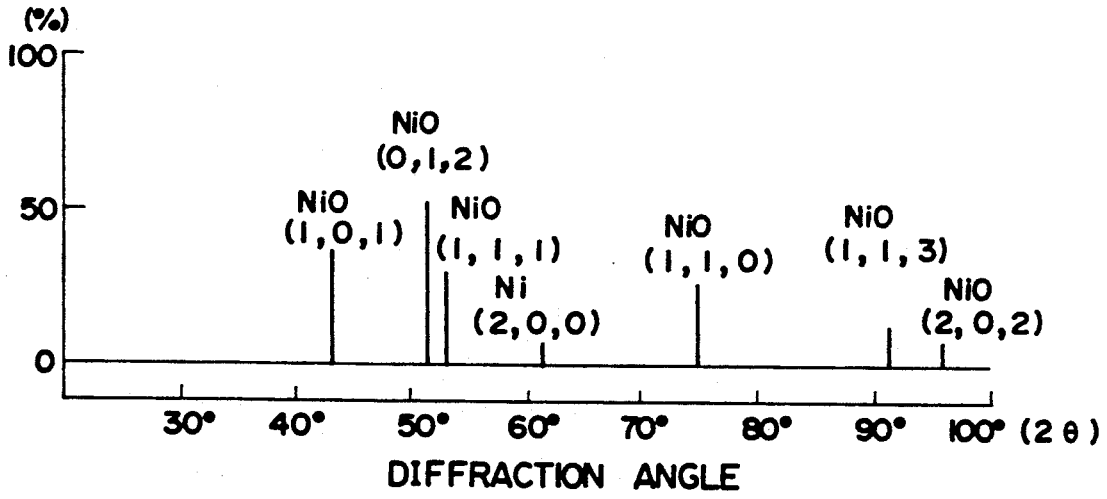
(%)
100
50
0
NiO
(0,1,2)
NiO
(1,0,1)
NiO
(1,1,1)
Ni
(2,0,0)
NiO
(1,1,0)
NiO
(1,1,3)
NiO
(2,0,2)
30°
40°
50°
60°
70°
80°
90°
100°
(2θ)
DIFFRACTION ANGLE

HYDROGEN-EVOLUTION ELECTRODE HAVING HIGH DURABILITY AND STABILITY

BACKGROUND OF THE INVENTION

1. Field Of The Invention

The present invention relates to a hydrogen-evolution electrode having high durability and stability. More particularly, the present invention is concerned with a highly durable, stable electrode having a coating comprised of an oxide of at least one metal selected from nickel and cobalt, which coating additionally contains titanium and zirconium components in specific proportions. The electrode may be used to conduct electrolysis of sodium chloride or water, during which electrolysis evolution of hydrogen occurs on the electrode in an alkaline solution. The electrode not only advantageously exhibits a low hydrogen overvoltage and high stability for a prolonged period of time but also is available at low cost.

2. Discussion Of Related Art

To attain energy cost saving, researches have been made in the electrolysis industry with respect to hydrogen-evolution electrodes. Especially, intensive efforts have been made to develop an active electrode which exhibits a low hydrogen overvoltage, thereby enabling the superfluous consumption of energy by the hydrogen overvoltage to be decreased. Various proposals have been made to provide an active hydrogen-evolution electrode exhibiting a low hydrogen overvoltage for a prolonged period of time. For example, there has been proposed a hydrogen-evolution electrode comprising an electrically conductive substrate having thereon a coating comprised of a titanium component and an oxide of at least one metal selected from the group consisting of nickel and cobalt, which titanium component is contained in the coating in a proportion of 0.5 to 20% in terms of atomic percentage of titanium (see Japanese Patent Application Laid-Open Specification No. 60-26682/1985). This electrode is characterized by the incorporation of a titanium component into the coating to prevent the metal oxide from being reduced to a metal. U.S. Pat. No. 4,605,484 (in which one of the inventors is also one of the present inventors) discloses a hydrogen-evolution electrode comprised of an electrically conductive substrate having thereon a coating layer comprising a chromium component and an oxide of at least one metal selected from the group consisting of nickel and cobalt, which chromium component is present in a proportion of 0.5 to 20% in terms of atomic percentage of chromium. Both of the above-mentioned electrodes in which titanium or chromium is used for the purpose of preventing the metal oxide from being reduced to a metal is considerably improved with respect to lowering of the hydrogen overvoltage and maintenance of the activity of the electrode for a prolonged period of time. However, the improvements are not sufficient. When an electrode in which titanium or chromium is incorporated for the purpose of preventing the metal oxide from being reduced is used as a hydrogen-evolution electrode in the electrolysis of an aqueous alkaline solution, the activity of the electrode can be maintained for a relatively long period of time. However, the titanium or chromium is gradually dissolved into the alkaline solution to lower the titanium or chromium content in the coating layer, thereby causing the metal oxide to be reduced to a metal and, hence, causing the overvoltage to increase with the lapse of time. Further, when the titanium or chromium content of the electrode is increased for overcoming the disadvantage caused by the dissolution of titanium or chromium, the lowering of hydrogen overvoltage is insufficient.

U.S. Pat. No. 4,839,015 discloses a hydrogen-evolution electrode comprising an electrically conductive substrate having thereon a coating comprising a chromium component, a titanium component and an oxide of at least one metal selected from the group consisting of nickel and cobalt. The chromium component and titanium component are present in proportions of 0.5 to 40% in terms of atomic percentage of chromium and 0.1 to 10% in terms of atomic percentage of titanium, respectively. This electrode has been proposed in order to overcome the disadvantage of the above-mentioned electrodes. This electrode has an advantage in that the reduction of the metal oxide to a metal is considerably suppressed, so that the activity of the electrode is maintained for a relatively long period of time.

However, when the electrolysis is conducted using the electrode of U.S. Pat. No. 4,839,015 for a long period of time the mechanical strength of the coating is occasionally lowered with the lapse of time. Therefore, it is not always possible to maintain the activity of the electrode for a prolonged period of time. The reason for the lowering of the mechanical strength of the coating is believed to be as follows. When the operation of the electrolysis is temporarily halted, an inverse current inevitably flows through the electrolytic cell for a moment. By the inverse current, the nickel in the coating is converted into nickel hydroxide. This conversion causes the activity of the electrode to be lowered and causes corrosion and dissolution of the coating to occur, leading to a lowering of the mechanical strength of the coating. The corrosion and dissolution of the coating are likely to occur especially when the alkali concentration of an electrolyte is high or the electrolysis is conducted at high temperatures.

SUMMARY OF THE INVENTION

The present inventors have made extensive and intensive studies with a view toward developing a hydrogen-evolution electrode which is free from the above-mentioned lowering of the mechanical strength of the electrode coating. As a result, the present inventors have unexpectedly found that the disadvantageous lowering of the mechanical strength of the electrode coating can be obviated, even under severe electrolytic conditions, such as a high temperature and a high alkali concentration, by the use of a novel coating comprising an oxide of at least one metal selected from the group consisting of nickel and cobalt, which coating additionally contains specific amounts of titanium and zirconium. Based on this unexpected finding, the present invention has been completed.

Accordingly, it is an object of the present invention to provide a hydrogen-evolution electrode which has durability and can be used in electrolysis on a commercial scale for a prolonged period of time without suffering from the lowering of the mechanical strength of the coating, which lowering is caused by the inverse current generated when the operation of electrolysis is temporarily halted, and which lowering is large especially when the electrolysis is conducted at a high temperature using an electrolyte having a high alkali concentration.

The foregoing and other objects, features and advantages of the present invention will be apparent from the following detailed description and appended claims taken in connection with the accompanying drawing.

BRIEF DESCRIPTION OF THE DRAWING

The accompanying drawing shows an X-ray diffraction pattern of an electrode coating comprising a nickel oxide, a titanium component and a zirconium component, wherein the contents of the titanium component and the zirconium component in the coating are 1.2% in terms of atomic percentage of titanium and 1.1% in terms of atomic percentage of zirconium, respectively.

DETAILED DESCRIPTION OF THE INVENTION

According to the present invention, there is provided a hydrogen-evolution electrode comprising an electrically conductive substrate having thereon a coating comprising a titanium component, a zirconium component and an oxide of at least one metal selected from the group consisting of nickel and cobalt, the titanium component and zirconium component being present in proportions of 0.1 to 3.5% in terms of atomic percentage of titanium and 0.1 to 3% in terms of atomic percentage of zirconium, respectively. The atomic percentage of titanium is defined by the formula:

$$\frac{A_{Ti}}{A_T} \times 100\ (\%) \qquad (1)$$

wherein $A_{Ti}$ represents the number of titanium atoms in the coating and $A_T$ represents the total number of atoms of titanium, zirconium and said at least one metal in the coating; and the atomic percentage of zirconium is defined by the formula:

$$\frac{A_{Zr}}{A_T} \times 100\ (\%) \qquad (2)$$

wherein $A_{Zr}$ represents the number of zirconium atoms in the coating and $A_T$ is as defined above.

As described hereinabove, the coating of the electrode according to the present invention comprises an oxide of at least one metal selected from the group consisting of nickel and cobalt, a titanium component and a zirconium component.

The oxide of at least one metal selected from the group consisting of nickel and cobalt in the coating enables the electrode to have a high catalytic activity, that is, enables the electrode to exhibit a low hydrogen overvoltage. The titanium component in the coating of the electrode imparts a reduction resistance to the oxide contained as an active material in the coating. The term "reduction resistance" used herein is intended to define such a property that the oxide as an active material in the electrode coating is not reduced and remains as an oxide even after the continuous operation of the electrolysis involving a hydrogen-evolution reaction.

The zirconium component in the coating of the electrode not only prevents a lowering of the mechanical strength of the coating, which lowering is caused by repeated passages of an inverse current generated at the time of the halt of the electrolysis, but also suppresses the dissolution of the titanium component, which imparts a reduction resistance to the oxide as mentioned above, into an aqueous alkali solution. It has not yet been elucidated in what manner the zirconium component exerts such an effect. However, it is due to the effect exerted by the zirconium component that the electrode according to the present invention is free from the lowering of the mechanical strength of the coating and has a life markedly longer than that of the conventional electrodes.

In the present invention, the coating of an electrode contains a titanium component in a proportion, in terms of atomic percentage of titanium, of from 0.1 to 3.5%. To effectively prevent the reduction of an oxide of at least one metal selected from the group consisting of nickel and cobalt, the content of the titanium component in the coating is at least 0.1%, preferably at least 0.2%, more preferably at least 0.5%, in terms of atomic percentage of titanium. On the other hand, an electrode having a coating containing a titanium component in a proportion of more than 3.5% is disadvantageous because the electrode suffers from a lowering of the mechanical strength of the coating because the adhesion is poor between the substrate and the coating of the electrode.

In the present invention, the coating of an electrode contains a zirconium component in a proportion, in terms of atomic percentage of zirconium, of from 0.1 to 3%. When the content of the zirconium component in the coating is smaller than 0.1%, the electrode suffers from a lowering of the mechanical strength of the coating and also suffers from a dissolution of the titanium component into the electrolyte. On the other hand, when the content of the zirconium component in the coating is larger than 3%, in terms of atomic percentage of zirconium, the electrode exhibits a disadvantageously high hydrogen overvoltage.

The content of a titanium component in the coating of an electrode (hereinafter often referred to as "titanium content") as used herein means a percentage of the number of titanium atoms in the coating relative to the total number of atoms of titanium, zirconium and at least one metal selected from nickel and cobalt in the coating. The content of the titanium component is determined by first mixing an aliquot of the coating with a flux, next melting the resultant mixture, subsequently adding hot water and aqueous sulfuric acid thereto, and then subjecting the thus obtained homogeneous solution to atomic absorption analysis or plasma emission spectrophotometry, as described later. Likewise, the content of the zirconium component in the coating of an electrode (hereinafter often referred to as "zirconium content") as used herein means a percentage of the number of zirconium atoms in the coating relative to the total number of atoms of titanium, zirconium and at least one metal selected from nickel and cobalt in the coating. The content of the zirconium component is determined according to substantially the same procedure as mentioned above with respect to the determination of the content of the titanium component.

An oxide of at least one metal selected from the group consisting of nickel and cobalt contained in the coating of the present invention may be nickel oxide, cobalt oxide and a mixture thereof, or a compound oxide containing nickel or cobalt. Among the oxides to be contained in the coating of the electrode of the present invention, nickel oxide is most preferred. Cobalt oxide is suitable for the purpose of the present invention. However, detailed comparison between nickel oxide and cobalt oxide shows that nickel oxide is excellent in activity as compared to cobalt oxide.

In the present invention, the titanium component may be titanium metal per se or an oxide thereof. Likewise, the zirconium component may be zirconium metal per se or an oxide thereof. The titanium and zirconium components may also be in a state of a solid solution with an oxide of at least one metal selected from the group consisting of nickel and cobalt, or may be in an amorphous state so as to assume a mixture thereof with the oxide of at least one metal selected from nickel and cobalt. Moreover, the titanium and zirconium components may be in the state of a compound oxide with at least one metal selected from the group consisting of nickel and cobalt.

Of the above-mentioned various states, from the viewpoint of the stable maintenance of the low hydrogen overvoltage for a prolonged period of time and the mechanical strength of the coating, it is preferred that at least a portion of each of the zirconium and titanium components be in a state of a solid solution with an oxide of nickel or cobalt or be in an amorphous state so as to assume a mixture thereof with the oxide of nickel or cobalt. Presence of the solid solution in the coating can be confirmed by studying the X-ray diffraction pattern of the coating. That is, for example, in the case where the coating contains a nickel oxide, the peak attributed to the solid solution of NiO with titanium and zirconium is observed, on the X-ray diffraction pattern of the coating, in a position slightly deviated from that of the peak attributed to the pure form of NiO. Also, whether the zirconium and titanium components are in an amorphous state can be examined by studying the X-ray diffraction pattern of the coating. That is, when they are in an amorphous state, the peaks attributed to zirconium and titanium are not observed.

It is preferred that the degree of oxidation of the coating of the electrode be in the range of from 20 to 99.5%. When the degree of oxidation of the coating is less than 20%, the coating is likely to suffer from a lowering of the activity within a short period of time. On the other hand, when the degree of oxidation of the coating is more than 99.5%, the electrical conductivity is poor due to the increased electrical resistance, and also, the catalytic activity of the coating is likely to be low, so that the hydrogen overvoltage is likely to be high.

The terminology "degree of oxidation" used herein is defined as a value (%) calculated by the formula:

$$\frac{H_1}{H_1 + H_0} \times 100 \quad (3)$$

wherein $H_0$ represents the height of the highest intensity X-ray diffraction peak of a metal when the X-ray diffraction pattern exhibits X-ray diffraction peaks ascribed to a single species of metal and exhibits none of X-ray diffraction peaks ascribed to other species of metals, or represents the sum of the heights of the highest intensity X-ray diffraction peaks of individual metals when the X-ray diffraction pattern exhibits X-ray diffraction peaks ascribed to a plurality of species of metals; and $H_1$ represents the height of the highest intensity X-ray diffraction peak of a metal oxide when the X-ray diffraction pattern exhibits X-ray diffraction peaks ascribed to a single species of metal oxide and exhibits none of X-ray diffraction peaks ascribed to other species of metal oxides, or represents the sum of the heights of the highest intensity X-ray diffraction peaks of individual metal oxides when the X-ray diffraction pattern exhibits X-ray diffraction peaks ascribed to a plurality of species of metal oxides.

When the titanium and zirconium components are in an amorphous state, no peak ascribed thereto appears on the X-ray diffraction pattern. On the other hand, when the titanium and zirconium components are in a state of solid solution, X-ray diffraction peaks ascribed thereto appear on the X-ray diffraction pattern.

With respect to the method of forming a coating on an electrically conductive substrate in the present invention, various techniques can be employed. For example, the following methods can be employed:

(1) a method in which a homogeneous solution is prepared from a salt (capable of forming an oxide under oxidative conditions) of nickel and/or cobalt and salts of titanium and zirconium, and the solution is applied onto an electrically conductive substrate, followed by baking in an oxygen-containing atmosphere;

(2) a method in which powdery nickel and/or cobalt component, which may be in the form of a metal per se, an oxide or a compound capable of forming an oxide under oxidative conditions, is mixed with powdery titanium and zirconium components, which may each be in the form of a metal per se, an oxide or a compound capable of forming an oxide under oxidative conditions, to thereby obtain a mixture, and the powdery mixture is applied onto a substrate by melt-spraying, such as plasma spraying and flame spraying (reference is made to, for example, U.S. Pat. Nos. 4,496,453, 4,605,484 and 4,839,015); and (3) a method in which a substrate is subjected to electroplating and/or chemical plating in a homogeneous solution containing an oxide-forming salt of nickel and/or cobalt and oxide-forming salts of titanium and zirconium, followed by oxidative-calcination in an oxygen-containing atmosphere.

In the above-mentioned method (1) comprising applying a homogeneous solution of metal salts followed by baking, suitable salts of nickel and/or cobalt, zirconium and titanium are, for example, nitrates, chlorides, formates, acetates and oxalates.

In the above-mentioned method (2) comprising melt-spraying, suitable forms of nickel and/or cobalt, titanium and zirconium components include, for example, oxides, hydroxides, carbonates, formates, oxalates and metals per se. Of these, oxides of these metals are most preferred.

In the above-mentioned method (3) comprising electroplating and/or chemical plating followed by oxidative-calcination, suitable salts of nickel and/or cobalt, titanium and zirconium are, for example, sulfates, chlorides, nitrates, acetates and trichloroacetates.

Of these methods, the method (2) comprising melt-spraying is most preferred from the viewpoints of the formation of a coating with a predetermined composition and the formation of an electrode having high activity which can be utilized for a prolonged period of time. In this method, the operations of melting of the powder and solidification and coating formation of the melted material on the substrate can be accomplished instantaneously, causing formation of a non-stoichiometric composition. With respect to the above-mentioned non-stoichiometric composition, an explanation is given below. In the case of the formation of a stoichiometric composition, oxidation of for example, nickel and titanium proceeds as follows:

$Ni^{2+} + O^{2-} \rightarrow NiO$, and $Ti^{4+} + O^{2-} \rightarrow TiO^{2}$.

However, in the case of the formation of a non-stoichiometric composition, oxidation of nickel and titanium proceeds as follows:

$Ni^{2+} + O^{2-} \rightarrow Ni_{1-x}O$, and $Ti^{4+} + O^{2-} \rightarrow TiO_{2-y}$ wherein each of x and y independently represents a factor which produces non-stoichiometry. This formation of a non-stoichiometric composition is believed to contribute to the enhanced activity of an electrode coating obtained by melt-spraying. Moreover, a uniform composition of a plurality of components can be easily obtained by mixing the components and granulating the mixture. Formulating such a uniform composition by melt-spray mixing, a desired electrode coating can be obtained. Therefore, the melt-spraying method is one of the most suitable methods for obtaining a hydrogen-evolution electrode having a coating of a plurality of specific components thereon, which coating is effective for attaining a high activity and long life.

In the melt-spraying method, it is important to improve the affinity between nickel and cobalt as the active ingredient and titanium and zirconium components as the activity-maintaining ingredient so that they may fully exhibit their respective functions. For this reason, it is preferred that the starting materials for forming an oxide of at least one metal selected from the group consisting of nickel and cobalt and the starting materials for forming titanium and zirconium components be sufficiently mixed, milled and processed into granules before being subjected to melt-spraying.

Various granulation techniques may be employed. They may be classified into several categories according to the type of apparatus, the state of the starting material, the granule-forming mechanism or the like. For example, the granulation of powder may be carried out by means of a rotary drum-type apparatus or rotary dish-type apparatus in which a mixture of powder and liquid is processed into granules due to capillary absorption action or chemical reaction. The granulation may also be carried out by means of a spraying and drying-type apparatus in which raw materials in the form of a solution or suspension are formed into granules due to surface tension, drying and crystallization. Further, the granulation may be carried out by means of a spraying and air cooling-type apparatus or spraying and water cooling-type apparatus in which a molten material is formed into granules due to surface tension, cooling and crystallization. Any of the above-mentioned granulation techniques can provide substantially spherical granules. Of the above-mentioned granulation techniques, the granulation by means of a spraying and drying-type apparatus is most preferred because it is advantageous in that uniformly porous granules are obtained so that the application of an active coating is facilitated and that well-bonded granules can be obtained, the size of the granules can be easily controlled, and granulation can be performed at low cost.

Detailed explanation is made below with respect to the granulation technique by means of this most preferred spraying and drying-type apparatus. Using this apparatus, a homogeneous suspension or solution is first prepared from starting material powders, a binding agent and water. Secondly, the suspension or solution is sprayed through a rotary disc, a two-channel nozzle, a pressure nozzle or the like to form liquid particles. Thirdly, the liquid particles are dried, thereby obtaining granules having a uniform composition, a uniform shape and a uniform size in which the components are bonded with a uniform bonding strength.

As a suitable binding agent to be employed for preparing granules, there can be mentioned water-soluble high molecular weight organic substances, such as polyvinyl alcohol, polyvinyl acetate, gum arabic, carboxymethyl cellulose, methyl cellulose, ethyl cellulose and the like. These high molecular weight organic substances serve as the binding agent for component powdery materials in the granule-forming step, thereby to provide granules wherein the components are bonded with desired bonding strength. During the melt-spraying step, however, these organic substances almost completely disappear due to combustion or decomposition so that these substances exert no adverse effect on the resultant coating on the electrode.

To stabilize the above-mentioned suspension or solution to be employed in the granulation for the purpose of obtaining uniform granules, there may be added a dispersant, antiflocculating agent, surfactant, antiseptic and the like. There is no particular limitation with respect to these agents, as long as these agents exert no adverse effect on the active coating on the electrode. Examples of dispersants include a sodium salt of carboxymethyl cellulose having a molecular weight of $200 \times 10^3$ or more, methyl cellulose having a molecular weight or $140 \times 10^3$ or more, polyethylene glycol having a molecular weight of $120 \times 10^3$ or more and the like. Examples of antiflocculating agents include sodium hexametaphosphate, ammonium citrate, ammonium oxalate, ammonium tartrate, monoethylamine and the like. Examples of surfactants include alkyl aryl phosphates, alkyl aryl sulfonate, fatty acid soap and the like. Examples of antiseptics include sodium phenoxide, phenol, phenol derivatives, formaldehyde and the like. Generally, it is preferred that the powder material concentration of the suspension or solution be in the range of from 30 to 90% by weight.

The size of the granules prepared by the granulation technique by means of a spraying and drying-type apparatus may be in the range of preferably from 1 to 200 μm, more preferably from 5 to 100 μm. When the granule size is too small, especially less than 1 μm, a large volume of dust occurs during the melt-spraying stage. This markedly lowers the melt-spraying yield, thereby causing performance of melt-spraying on a commercial scale to be difficult. On the other hand, when the granule size is too large, particularly more than 200 μm, complete melting of the granules becomes difficult, so that various problems occur, such as degradation of electrode activity, shortening of electrode life, lowering of coating strength and decrease of melt-spray yield, which are all attributed mainly to incomplete melting of the granules.

It is preferred that the granules have a crushing strength of 0.5 g/granule or more. Such a level of crushing strength is needed to maintain their morphology during the storage and transportation after the granule formation. The crushing strength of the granules can be varied by changing the amount and/or kind of the binding agent to be employed.

As the suitable method for melt-spraying the granules, there may be mentioned, for example, flame spraying and plasma spraying. Of the above-mentioned techniques, plasma spraying is more preferred.

Detailed explanation is made below with respect to the plasma spraying technique. According to this technique, at least one type of gas selected from argon, nitrogen, hydrogen, helium and other gases is passed through a direct-current arc slit to thereby cause dissociation and ionization of the gas. This enables production of a plasma flame having a temperature as high as several thousand to more than ten thousand degrees centigrade and having a desired heat capacity and a high speed. The granules may be conveyed by an inert gas and poured in the plasma flame. The granules poured in the plasma flame is caused to melt fly and collide against the surface of the electrode substrate. Then, the molten material on the electrode substrate may be cooled and solidified, to thereby form a coating on the substrate. The above-mentioned melting, flight and collision of the material can be accomplished instantaneously, for example, generally in a period of from 0.1 to 10 milliseconds. The temperature, heat capacity and speed of the plasma flame primarily depend on the type of gas employed and on the power of the arc. As the suitable gas to be employed for producing the plasma flame, there may be mentioned mixtures of gases, such as argon and nitrogen, argon and hydrogen, and nitrogen and hydrogen. The power of the arc depends on the arc current and arc voltage. The arc voltage, at a fixed value of arc current, depends on the inter-electrode distance and the type and flow rate of plasma gas. When a gas requiring a high energy for dissociation and ionization of molecules, such as nitrogen, is employed, the arc voltage is likely to increase. On the other hand, when a gas which consists of single-atom molecules and which can be readily ionized, such as argon, is employed, the arc voltage is likely to decrease. At any rate, there is no particular restriction in connection with the power of the arc as long as a plasma flame can be provided having a temperature and heat capacity sufficient to accomplish the above-mentioned melting of the granules instantaneously.

As the other conditions affecting the melt-spraying, there may be mentioned the distance from the spray nozzle to the substrate to be spray coated and the angle at which the spray nozzle is disposed with respect to the face of the substrate to be spray coated. Generally, the distance from the spray nozzle to the substrate to be coated is preferably 50 to 300 mm, and the angle at which the spray nozzle is disposed with respect to the substrate to be coated is preferably 30° to 150°. Further, the method for pouring the granules in the plasma flame and the method for cooling the melt-sprayed material may affect the melt-spraying. However, these conditions are not of a critical nature and may be chosen from the conditions customarily employed.

In addition to the above-mentioned components, an additional component selected from zinc, zinc oxide, aluminum, silicon dioxide, molybdenum, molybdenum oxide and other substances may be incorporated in the granules. Incorporation of such an additional component is advantageous since it further improves the activity of the resultant electrode and further decreases the hydrogen overvoltage.

The preferred thickness of the coating of electrode is 10 to 300 μm. When the thickness of the coating is less than 10 μm, there cannot be obtained an electrode exhibiting a satisfactorily lowered hydrogen overvoltage. On the other hand, a thickness of the coating which exceeds 300 μm is not advantageous from an economical viewpoint because even if the coating thickness is more than 300 μm, the hydrogen overvoltage is not lowered beyond a certain value.

Explanation will now be made on an electrically conductive substrate to be used for preparing the hydrogen-evolution electrode of the present invention. The electrically conductive substrate of electrode should be sufficiently resistant to an electrolytic solution not only at a potential of the substrate during the electrolysis but also at a potential of the substrate at the time when the electrolysis is not effected. The surface of a substrate having an active, porous coating thereon has a potential which is noble as compared with the potential on the surface of the coating even during a period of time in which hydrogen is evolved from the surface of the coating of the electrode. Therefore, it is not unusual that the potential at the surface of the substrate is noble as compared with the dissolution-deposition equilibrium potential of iron. Examples of materials, which have an anticorrosive property sufficient for use as the substrate of the electrode of the present invention and are commercially available, include nickel, a nickel alloy, an austenite type stainless steel, a ferrite type stainless steel and the like. Of the above-mentioned materials, nickel, a nickel alloy and an austenite type stainless steel are preferred, and nickel and a nickel alloy are especially preferred. Besides, those which are each composed of an electrically conductive substrate having on its surface a non-pinhole coating of nickel, a nickel alloy or an austenite type stainless steel may also preferably be used as the substrate of electrode. Such a non-pinhole and anti-corrosive coating may be obtained by known techniques, for example, electroplating, chemical plating, melt-plating, rolling, pressure-adhesion by explosion, cladding, vapor deposition, ionization plating and the like.

It is preferred that the substrate of the electrode have a shape such that hydrogen gas generated during the electrolysis can be smoothly released so that a superfluous voltage loss due to the current-shielding by the hydrogen gas may be avoided and such that the effective surface area for electrolysis is large so that the current is hardly concentrated. The substrate having such a shape can be prepared from a wire screen having a suitable wire diameter and spacings between the respective adjacent wires, a perforated metal plate having a suitable thickness, size of openings and pitch of opening arrangement, an expanded metal having suitable lengths of long axis and short axis, or the like.

The electrode of the present invention can be effectively used as a hydrogen-evolution electrode in various electrolyses, such as electrolysis of sodium chloride by the ion exchange membrane process or the diaphragm process, electrolysis of alkali metal halides other than sodium chloride, electrolysis of water and electrolysis of Glauber's salt. It is preferred that an electrolytic solution to be in contact with the electrode of the present invention be alkaline. The type of an electrolytic cell to be used together with the electrode of this invention may be of either monopolar arrangement or bipolar arrangement. When the electrode of the present invention is used in the electrolysis of water, it may be used as a bipolar electrode.

The coatings of conventional hydrogen-evolution electrodes are likely to suffer from a lowering of mechanical strength which is caused by repeated passages of an inverse current under severe electrolytic conditions, such as a high temperature and a high alkali concentration. The lowering of mechanical strength in turn causes a coming-off of portions of the coating from the electrode, which is determined by measuring a weight decrease of the coating. The coming-off of portions of the coating adversely affects the activity of the coating, thereby leading to a disadvantageous increase in hydrogen overvoltage. Moreover, in the coatings of conventional hydrogen-evolution electrodes, the conversion of an oxide of nickel and/or cobalt to a hydroxide compound is brought about by repeated passages of an inverse current, which hydroxide compound disadvantageously increases hydrogen overvoltage.

By contrast, in the hydrogen-evolution electrode of the present invention, the lowering of mechanical strength and the adverse effect of the hydroxide compound, both of which are caused by the inverse current flowing at the time of temporarily halting the electrolytic operation, can be effectively suppressed by the incorporation of specific amounts of titanium and zirconium components. Therefore, the electrode of the present invention can be stably used while maintaining high activity for a prolonged period of time.

The present invention will now be further illustrated in more detail with reference to the following Examples which should not be construed to be limiting the scope of the present invention.

In the Examples, various measurements are made as follows.

Atomic percentages of titanium and zirconium

The atomic percentages of a titanium and a zirconium in the coating of an electrode are determined by the ICAP (inductively coupled argon plasma emission spectrophotometer) method as follows.

One part by weight of the coating of an electrode is mixed with 50 parts by weight of a flux (a mixture of 2 parts by weight of sodium peroxide and one part by weight of sodium carbonate) and the resultant mixture is calcined at a temperature of 600 ° C. or more. A predetermined amount of hot water and aqueous 50% sulfuric acid are added to the resultant mixture to obtain a homogeneous solution. The obtained solution is used as the sample. The experimental conditions and apparatus used are as follows.

| Type of atom | Wave length(nm) | Apparatus |
|---|---|---|
| Ni | 231.604 | ICAP-575 type Mark II (manufactured and sold by Nippon Jarrell-Ash Co. Ltd., Japan) |
| Co | 238.892 | " |
| Ti | 336.121 | " |
| Zr | 343.823 | " |

The following values are obtained as follows.

Diameter of granules

Measured by an electron microscopic method.

Water content of granules

Measured by an infrared drying method.

Crushing strength

Granules having a diameter of 30–44 μm are classified by means of a sieve. The minimum load (g) to crush a granule is determined with respect to 30 granules. The obtained values of load (g) are averaged.

Degree of oxidation

Determined by an X-ray diffractometry, as described hereinbefore. Conditions of X-ray diffractometry are as follows.

Target Co, kV-mA 29-10
Filter Fe, Full Scale $1\times10^3$ c/s
Time Const. 2 sec.
Scan. Speed 1°/min
Chart Speed 1 cm/min
Detector S.C.

EXAMPLE 1

A mixture consisting of 100 parts by weight of powdery nickel oxide (NiO), 1.1 parts by weight of powdery titanium oxide ($TiO_2$) and 1.8 parts by weight of powdery zirconium oxide ($ZrO_2$) is added to an aqueous solution consisting of 100 parts by weight of water, 2.25 parts by weight of gum arabic as a binder, 0.7 part by weight of carboxymethyl cellulose as a dispersant, 0.001 part by weight of sodium lauryl sulfate as a surfactant and 0.1 part by weight of phenol as an antisepic agent. The resultant mixture is vigorously stirred to obtain a homogeneous suspension.

The particle diameters of the nickel oxide, the titanium oxide and the zirconium oxide are measured as follows.

The powdery nickel oxide is mixed with distilled water and a dispersant, and after sufficient stirring, the mixture is sprayed onto a copper mesh by means of a nebulizer, and dried. An electron photomicrograph is taken of the resultant nickel oxide powder.

The same procedure as used for nickel oxide is applied to the titanium oxide and the zirconium oxide.

From the electron photomicrographs, it is found that the particle diameter of the nickel oxide is in the range of from 0.2 to 2 μm, that the particle diameter of the titanium oxide is in the range of from 1 to 10 μm, and that the particle diameter of the zirconium oxide is in the range of 0.1 to 1 μm.

The suspension is dried and granulated by means of a spraying and drying type granulation chamber (hereinafter often referred to simply as "granulation chamber") having a diameter of 1 m and a height of 0.7 m and equipped at its top with a rotating disc. In this step, the suspension is fed to the granulation chamber at the rotating disc being rotated at 25,000 r.p.m. at a feed rate of 40 kg/hr by means of a pump, whereby the suspension becomes droplets and is dispersed while being subjected to gravity-dropping toward the bottom of the granulation chamber. A hot air of 330° C. is fed to the granulation chamber so that the hot air flows in the same direction as the dispersed droplets fall. The flow rate of the hot air is adjusted so that the hot-air temperature is 120° C. at the outlet of the hot air located at the side portion of the bottom of the granulation chamber. Spherical granules having temperatures of 95° to 100° C. are produced at a production rate of about 18 kg/hr. The produced granules are taken out from the bottom of the granulation chamber and allowed to stand for cooling. The obtained granules are 5 to 50 μm in diameter as determined by the electron microscopic method, 5 g/granule in crushing strength and less than 0.1% in water content.

A 5 cm×5 cm nickel wire screen (wire diameter, 0.7 mm; 14 mesh) is degreased with trichlene, and then both sides thereof are blasted by means of $Al_2O_3$ having a particle size of 0.73 to 2.12 mm. The blasted wire screen (substrate) is melt spray coated on both sides thereof with the above-prepared granules by plasma spraying as indicated below. The plasma spraying is repeated 3 times with respect to each side of the wire screen to produce an electrode having a coating of a thickness of 150 μm with respect to one side of the wire screen and 100 μm with respect to the other side of the wire screen.

Plasma spraying is done using the following average spraying parameters.

Feeding rate of plasma gas of nitrogen and hydrogen: 2 $m^3$ (at normal state)/hr and 0.4 $m^3$ (at normal state)/hr, respectively.

Distance between substrate and spray gun (spray distance): 10 cm

Angle of the plasma flame relative to the face of the substrate: 90°

The same procedure as described above is repeated to prepare another electrode, and the composition of the coating of the electrode and the degree of oxidation of the coating are determined as follows.

Using an inductively coupled argon plasma emission spectrophotometer described hereinbefore, it is found that the titanium component content and the zirconium component content are 1.2% in terms of atomic percentage of titanium and 1.1% in terms of atomic percentage of zirconium, respectively.

The coating is subjected to X-ray diffractometry to determine the crystal structure of the coating. The obtained X-ray diffraction pattern is shown in FIGURE. In the X-ray diffraction pattern, the peaks attributed to NiO and Ni are observed, from which the degree of oxidation is calculated to be 62%. In the X-ray diffraction pattern, there is no peak attributed to titanium oxide, titanium metal, zirconium oxide, zirconium metal, a compound oxide of nickel and titanium and a compound oxide of nickel and zirconium (see FIGURE). Further assuming from the peak of NiO that NiO is in the form of a cubic crystal, the lattice constant of NiO is calculated from the position of the peak of NiO. As a result, the lattice constant is found to be 4.175 Å. By contrast, the lattice constant of NiO of a further electrode, which has been prepared in substantially the same manner as in Example 1 except that only powdery nickel oxide is used instead of the combination of powdery nickel oxide, powdery titanium oxide and powdery zirconium oxide, is 4.178 Å. Therefore, it is believed that titanium and zirconium components are present together with the nickel oxide in the form of a solid solution or in an amorphous form.

There is provided an electrolytic cell provided with a platinum wire electrode as an anode and introduction means for additionally introducing a 40% by weight aqueous solution of sodium hydroxide during electrolysis. In the electrolytic cell, a 45% aqueous solution of sodium hydroxide is initially contained. The above-obtained electrode is installed as a cathode in the electrolytic cell in such a manner that the side of the cathode on which a 150 μm-thick coating is formed faces the platinum wire anode. While supplying a 40% by weight aqueous solution of sodium hydroxide into the cell through the above-mentioned introduction means so that the sodium hydroxide concentration of the aqueous solution in the cell is maintained at 45% by weight, electrolysis is continuously conducted at a current density of 100 A/$dm^2$ and at 100 ° C. During the electrolysis, hydrogen and oxygen gases are evolved. The hydrogen overvoltage is measured by the current interrupt method. In the measurement, Luggin capillary is connected to a reference electrode (Hg/HgO;25 ° C.) by means of liquid junction and in turn is connected to the surface of the cathode facing the cation exchange membrane.

The electrolysis is conducted for 800 hours while compulsorily applying an inverse current of 0.3 A/$dm^2$ once a day for one hour, and the hydrogen overvoltage, the degree of oxidation of the coating and the weight decrease of the coating are measured. The results are shown in Table 1.

TABLE 1

| | Hydrogen overvoltage (40 A/$dm^2$) | Degree of oxidation | Weight decrease in weight |
|---|---|---|---|
| At initial stage | 180 mV | 62% | — |
| After 800 hrs | 250 mV | 50% | 3% |

The results show that the increase in hydrogen overvoltage is slight and substantially no weight decrease of the coating is observed.

EXAMPLE 2 to 6

Electrodes are prepared in substantially the same manner as described in Example 1 except that the amounts of oxides are changed so as for the coating to contain titanium and zirconium in the amounts indicated in Table 2. The titanium content and the zirconium content are summarized for each electrode in Table 2. The degree of oxidation determined by X-ray diffractormetry ranges from 62 to 65%. Electrolysis is carried out in the same manner and under the same conditions as described in Example 1, to thereby measure hydrogen overvoltage values and weight loss values of the coatings in the same manner as in Example 1. The results are shown in Table 2.

EXAMPLE 7 to 9

Electrodes are prepared in substantially the same manner as described in Example 1, except that cobalt oxide is used instead of nickel oxide and the amounts of oxides are changed so as for the coating to contain titanium and zirconium in the amounts indicated in Table 2. The measurement by means of an electron microscope shows that the particle diameter of the cobalt oxide ranges from 0.4 to 2 μm. The titanium content and the zirconium content are summarized for each electrode in Table 2. The degree of oxidation determined by X-ray diffractormetry ranges from 68 to 74%. Electrolysis is carried out in the same manner and under the same conditions as described in Example 1, to thereby measure hydrogen overvoltage values and weight loss values of the coatings in the same manner as in Example 1. The results are shown in Table 2.

EXAMPLE 10 AND COMPARATIVE EXAMPLES 1 to 5

Electrodes are prepared in substantially the same manner as in Example 1, except that the types and atomic percentages of other than nickel oxide are changed as indicated in Table 2 and that as a plasma gas a mixed gas of argon and nitrogen is used instead of the mixed gas of nitrogen and hydrogen and the argon and nitrogen are flowed at rates of 1 $m^3$(in normal state)/hr and 0.8 $m^3$(in normal state)/hr, respectively. The chromium oxide used in Comparative Example 5 has a particle diameter of from 0.5 to 3 μm. The titanium content and the zirconium content are summarized for each electrode in Table 2. The degree of oxidation determined by X-ray diffractometry ranges from 85 to 87%. Electrolysis is carried out in the same manner and under the same conditions as described in Example 1, to thereby measure hydrogen overvoltage values and weight loss values of the coatings in the same manner as in Example 1. The results are shown in Table 2.

TABLE 2

| | At initial stage | | | | | After 800 hours | | |
|---|---|---|---|---|---|---|---|---|
| | Titanium content (atomic %) | Zirconium content (atomic %) | Chromium content (atomic %) | Degree of oxidation of coating (%) | Hydrogen overvoltage (mV) at 40 A/$dm^2$ | Ratio of weight loss of coating (%) | Degree of oxidation of coating (%) | Hydrogen overvoltage (mV) at 40 A/$dm^2$ |
| Example 2 | 1 | 0.2 | — | 64 | 170 | 5 | 36 | 200 |
| Example 3 | 1 | 0.5 | — | 65 | 180 | 4 | 38 | 200 |
| Example 4 | 2 | 0.2 | — | 63 | 175 | 5 | 45 | 200 |
| Example 5 | 2 | 0.5 | — | 62 | 180 | 3 | 49 | 195 |
| Example 6 | 2 | 1 | — | 64 | 180 | 3 | 48 | 200 |
| Example 7 | 1 | 1 | — | 68 | 180 | 3 | 30 | 210 |
| Example 8 | 1 | 0.5 | — | 74 | 180 | 4 | 24 | 215 |
| Example 9 | 2 | 0.5 | — | 69 | 180 | 3 | 28 | 210 |
| Example 10 | 2 | 2 | — | 87 | 190 | 5 | 66 | 205 |
| Comparative Example 1 | 1 | 0 | — | 85 | 180 | 46 | 26 | 295 |
| Comparative Example 2 | 2 | 4 | — | 87 | 230 | 10 | 60 | 270 |
| Comparative Example 3 | 1 | 0.05 | — | 85 | 170 | 44 | 25 | 295 |
| Comparative Example 4 | 2 | 0 | — | 86 | 190 | 80 | 55 | 320 |
| Comparative Example 5 | 2 | — | 10 | 86 | 170 | 76 | 60 | 330 |

What is claimed is:

1. A hydrogen-evolution electrode comprising an electrically conductive substrate having thereon a coating comprising a titanium component, a zirconium component and an oxide of at least one metal selected from the group consisting of nickel and cobalt, said titanium component and zirconium component being present in proportions of 0.1 to 3.5% in terms of atomic percentage of titanium and 0.1 to 3% in terms of atomic percentage of zirconium, respectively, said atomic percentage of titanium being defined by the formula:

$$\frac{A_{Ti}}{A_T} \times 100\ (\%) \qquad (1)$$

wherein $A_{Ti}$ represents the number of titanium atoms in the coating and $A_T$ represents the total number of atoms of titanium, zirconium and said at least one metal in the coating, said atomic percentage of zirconium being defined by the formula:

$$\frac{A_{Zr}}{A_T} \times 100\ (\%) \qquad (2)$$

wherein $A_{Zr}$ represents the number of zirconium atoms in the coating and $A_T$ is as defined above.

2. The electrode according to claim 1, wherein said electrically conductive substrate is comprised of an anticorrosive material selected from the group consisting of nickel, a nickel alloy, and an austenite stainless steel.

3. The electrode according to claim 1 or 2, wherein said coating comprises a nickel oxide, nickel, titanium and zirconium.

4. The electrode according to claim 1, wherein said coating has a degree of oxidation of 20 to 99.5%, said degree of oxidation being defined by the formula:

$$\frac{H_1}{H_1 + H_0} \times 100\ (\%) \qquad (3)$$

wherein $H_0$ represents the height of the highest intensity X-ray diffraction peak of a metal when the X-ray diffraction pattern exhibits X-ray diffraction peaks ascribed to a single species of metal and exhibits none of the X-ray diffraction peaks ascribed to other species of metals, or represents the sum of the heights of the highest intensity X-ray diffraction peaks of individual metals when the X-ray diffraction pattern exhibits X-ray diffraction peaks ascribed to a plurality of species of metals; and $H_1$ represents the height of the highest intensity X-ray diffraction peak of a metal oxide when the X-ray diffraction pattern exhibits X-ray diffraction peaks ascribed to a single species of metal oxide and exhibits none of X-ray diffraction peaks ascribed to other species of metal oxides, or represents the sum of the heights of the highest intensity X-ray diffraction peaks of individual metal oxides when the X-ray diffraction pattern exhibits X-ray diffraction peaks ascribed to a plurality of species of metal oxides.

* * * * *